United States Patent [19]

Kempers

[11] Patent Number: 4,576,197

[45] Date of Patent: Mar. 18, 1986

[54] PUMP SUCTION VACUUM LIFT VORTEX CONTROL

[75] Inventor: Eugene K. Kempers, Sioux City, Iowa

[73] Assignee: Midwest Energy Services Company, Sioux City, Iowa

[21] Appl. No.: 426,905

[22] Filed: Sep. 29, 1982

[51] Int. Cl.[4] ..... E03B 11/00

[52] U.S. Cl. ..... 137/565; 137/1; 137/573; 137/574; 137/576; 137/592; 417/38; 417/60

[58] Field of Search ..... 417/36-40, 417/360; 137/565, 573, 574, 576, 590, 592, 593, 1

[56] References Cited

U.S. PATENT DOCUMENTS

| | | | |
|---|---|---|---|
| 895,768 | 8/1908 | Koenigkramer et al. | 222/189 |
| 1,120,351 | 12/1914 | Weston | 137/573 |
| 1,148,500 | 8/1915 | Caverno | 137/576 |
| 1,635,414 | 7/1927 | Hirst | 137/574 |
| 1,644,248 | 10/1927 | Goldman | 210/299 |
| 2,137,300 | 11/1938 | Allen | 137/574 |
| 2,660,312 | 11/1953 | Snyder et al. | 210/94 |
| 2,851,193 | 9/1958 | Hobson | 137/590 |
| 3,128,786 | 4/1964 | Badgett | 137/565 |
| 3,188,974 | 6/1975 | Rosaen | 103/203 |
| 3,342,135 | 4/1967 | Schnabel, Jr. | 417/38 |
| 3,476,038 | 11/1969 | Dicmas | 103/220 |
| 4,232,998 | 11/1980 | Osgood | 417/36 |

FOREIGN PATENT DOCUMENTS

| | | | |
|---|---|---|---|
| 136293 | 2/1950 | Australia | 137/565 |
| 92808 | 11/1959 | Netherlands | 137/574 |

OTHER PUBLICATIONS

Allis-Chalmers Engineering Review, vol. 40, No. 1, 1975, Selected pages.

Cameron Hydraulic Data, Sixteenth Ed., 2nd Printing, Ingersoll-Rand.

Hydraulic Institute Standards, Thirteenth Ed., Selected pages.

Pump Handbook, by Karassik et al, McGraw-Hill Book Co., Selected pages.

*Primary Examiner*—A. Michael Chambers

*Attorney, Agent, or Firm*—Harry J. Watson

[57] ABSTRACT

The invention involves positioning the working end of a vertical pump below the surface elevation of the fluid, enclosing a space around the pump with a structure extending below the surface and having a submerged opening to the main reservoir, and drawing a vacuum in the enclosed space in order to raise the surface elevation in the enclosed chamber in order to maintain a minimum working depth for the vertical pump that will prevent air entrainment by vortexing during periods of low fluid levels outside the chamber.

9 Claims, 8 Drawing Figures

SECTION A-A FROM FIGURE 4

PUMP SUCTION VACUUM LIFT VORTEX CONTROL

BACKGROUND OF THE INVENTION

Many operations require a continuous supply of fluid, usually water, from a large fluid source such as a reservoir or river. Often water is pumped in order to provide a cooling fluid for critical heat transfer devices such as steam condensers in power plant operations where the loss of the continuous supply of cooling water can have disastrous consequences on the continued operation of equipment. Thus it is important to have a continuous reliable supply of cooling fluid.

In order to supply large volumes of fluid, suction pumps are usually employed in the natural environment of a reservoir or other large source of fluid. Suction pumps are suspended in an intake structure usually made of steel and concrete in the form of a large enclosed chamber which supports and protects the suction pump. Commonly one end of the enclosed chamber is open to the fluid source except for "grizzley bars" over the submerged opening in the intake structure and which serve to rough screen out large debris, large fish and other water creatures that may be attracted to the intake. Intake water which travels through the grizzley bars into the enclosure is usually subjected to a finer mesh screen of a fixed or continuously rotating nature which serves to further protect the suction pumps and downstream equipment from finer debris particles and small fish. Even after passing through these screening devices some floating debris or chunks of ice can still be present in the dead ended portion of the intake structure closest toward the land where the suction pump is usually located.

Most of the water sources that are available for such uses are subject to natural variations in elevation caused by such things as tides, ice jams, rainfall, evaporation, or the operation of hydroelectric dams in waterways.

The suction pumps employed are usually vertical centrifugal pumps which extend through the top of the intake support structure into the pumping chamber while remaining a sufficient distance above the bottom of the pumping chamber so as to avoid restrictions on permissible flow into the pump intake and impeller. There are many different manufacturers and impeller designs for suction pumps but each individual suction pump has its own pump characteristics which are fixed. These are well known and are plotted on graphs which relate the flow rate of the pump to the pump submergence depth in the pumping fluid. Once a particular intake support structure is fixed in place, the pump chamber water elevation can be used in these plots as a measure of submergence depth.

There are two main problems that arise in the operation of suction pumps if the fluid level in the pumping chamber falls below the minimum submergence depth required for any particular pump. The first of these is called vortexing and the second may be referred to as cavitation. This invention is directed toward elimination of the vortexing component of the submergence requirement for a given pump so that it may be operated where the natural level of the fluid source provides less than the minimum required submergence depth for vortexing. This situation usually occurs when a large and expensive fixed pump intake structure is in place and the water level in the reservoir drops below the expected minimum level or when because of the difficulty of calculating the resistances in pipes and components connected to the output of the pump, the flow rate varies from designed flow rate which in turn moves the pump operation to a different place on the characteristic curve to where a greater than original design submergence would be required for proper operation.

Vortexing is a condition which begins once the pump is operated below the minimum required submergence depth and gradually worsens as submergence depth is decreased until finally it allows air to enter the pump through a "tornado" shaped cone which forms at the surface of the fluid. The vortices may be multiple in nature. In addition to undesirably entraining air into the pump it creates hydraulic disturbance in the flow pattern of the fluid and results in unwanted mechanical forces on the pump which may cause damage. Entrained air seriously interferes with upstream heat transfer equipment and generally causes problems in closed systems. The swirling vortices entrain floating debris down through the fluid to the pump intake to further enhance the pump disturbances and they provide material to clog and otherwise interfere with upstream equipment. Pump efficiency can be adversely affected by these conditions.

Usually vortexing is the critical limitation on submergence depth and once this limitation is removed the pump can be operated at a reduced submergence level until it reaches the reduced depth where cavitation becomes a problem. Cavitation is the formation of water vapor bubbles and a subsequent sudden collapse of the bubbles which causes pump noise, rough operation of the pump, and damage under prolonged operation in that condition. The cavitation condition is often represented by NPSHR which refers to net positive suction head requirement. NPSHA is a term used which means the net positive suction head available. Curves similar to the vortexing curves are drawn for pumps relating the NPSHR in terms of flow rate and submergence depth of a pump. They are characteristic curves just like the vortexing curves and the failure to maintain the required NPSH give rise to the pumping and impeller wear problems which are generally recognized under the label cavitation. Once the vortexing problem is removed then the minimum submergence depth is controlled by the NPSH curve characteristic of the pump which as was indicated is usually much lower than the minimum depth required by the vortexing characteristic of the pump. Previous attempts to solve the vortexing problem when the submergence level is less than what the characteristic curve requires are basically devices that interfere with the formation of vortexes in the pump fluid. They generally take the form of a floating raft usually in the form of a grid or a perforated steel plate or a screen which is located at or near the surface of the fluid level in the pumping chamber. These devices may be expensive to build and difficult to maintain and present the potential problem of pluggage with debris or ice formations which can cause even more serious problems with pump operation. They can become plugged in a relative short time and it is difficult to predict when plugging will occur. The condition of the screen or plate is difficult or impossible to monitor and maintain and it is difficult to correct the problem when it does occur without significant and disruptive down time of the pump.

BRIEF SUMMARY OF THE INVENTION

I have discovered that a far more satisfactory solution to the vortexing problem in suction pump operation can be obtained by extending a wall downwardly from the top of the pumping chamber enclosure on the outward or reservoir side of the enclosure to slightly below the low water elevation in the support intake structure so that a fluid seal is formed. An opening still remains between the floor of the intake structure enclosure and the lower portion of the downwardly extending wall. The opening that remains is an underwater opening which is large enough to permit adequate flow of the fluid into the pumping chamber without a pressure drop across the opening that would be large enough to interfere with flow or with satisfactory pump operation. The downwardly extending wall may be fixedly or removably installed. The pumping chamber thus formed inwardly of the downwardly extending wall which contains the suction pump is sealed to prevent the entrance of atmospheric air leakage. Any other openings in the enclosure thus formed must be below the water level and preferably below the lower most extension of the downwardly extending wall so that they also would have a similar water seal.

Once the pumping chamber has been sealed above the fluid level it becomes possible to induce a vacuum into the pumping chamber by means which removes atmospheric air at a rate sufficiently greater than the leakage rate so that the fluid level in the pumping chamber rises to a level that depends mainly on the difference between the vacuum pressure and the outside pressure of the atmosphere. The greater external atmospheric pressure forces the column of fluid in the pumping chamber to rise up and thus increases the submergence depth of the suction pump since it is fixed to the intake support structure and does not move. Once the minimum submergence depth of the pump is established then the characteristic vortexing curve for the pump dictates that vortexing cannot occur and vortexing ceases to be a problem or limitation for pump operation.

The level of the fluid in the pump chamber enclosure is adjusted and controlled by adjusting the amount of vacuum in it by a pressure relief valve or vacuum pump speed control to make sure that a proper submergence depth is adhered to.

DETAILED DESCRIPTION AND SPECIFICATION

Figure 1:
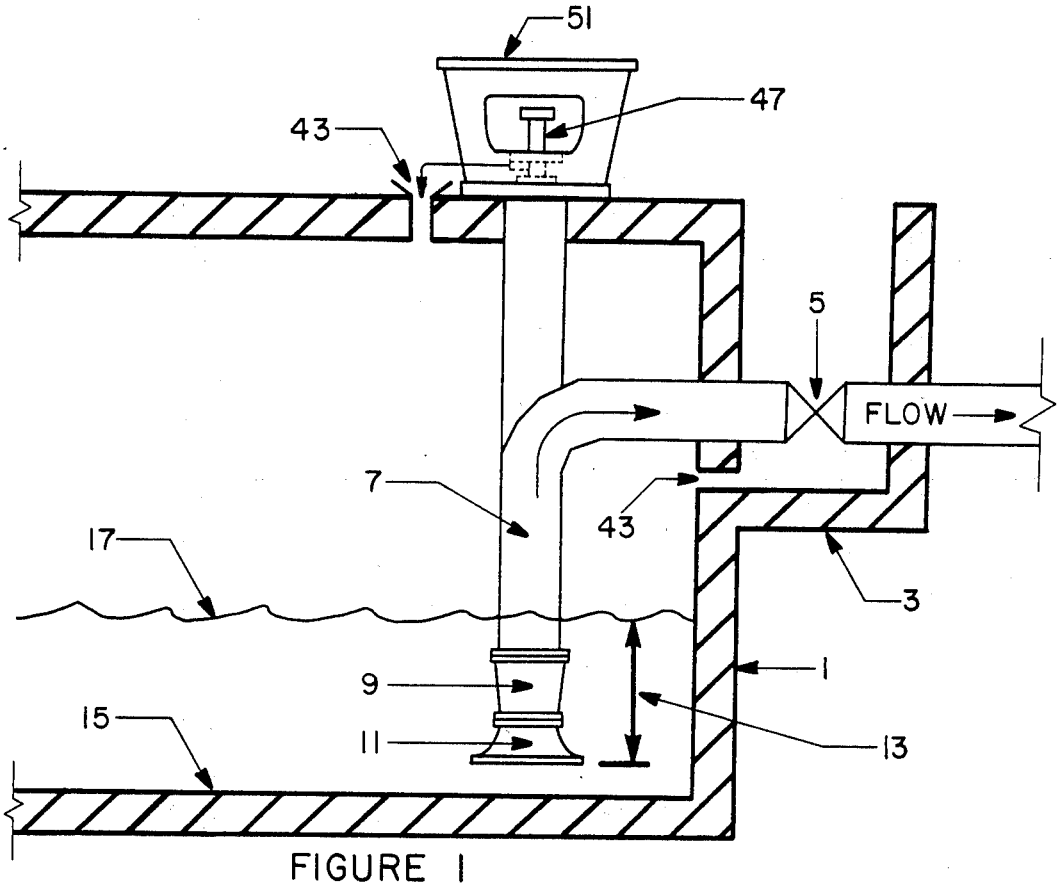
FIG. 1 is a cross sectional side elevation of the typical input support structure and pump installation without vortexing.
Figure 3:
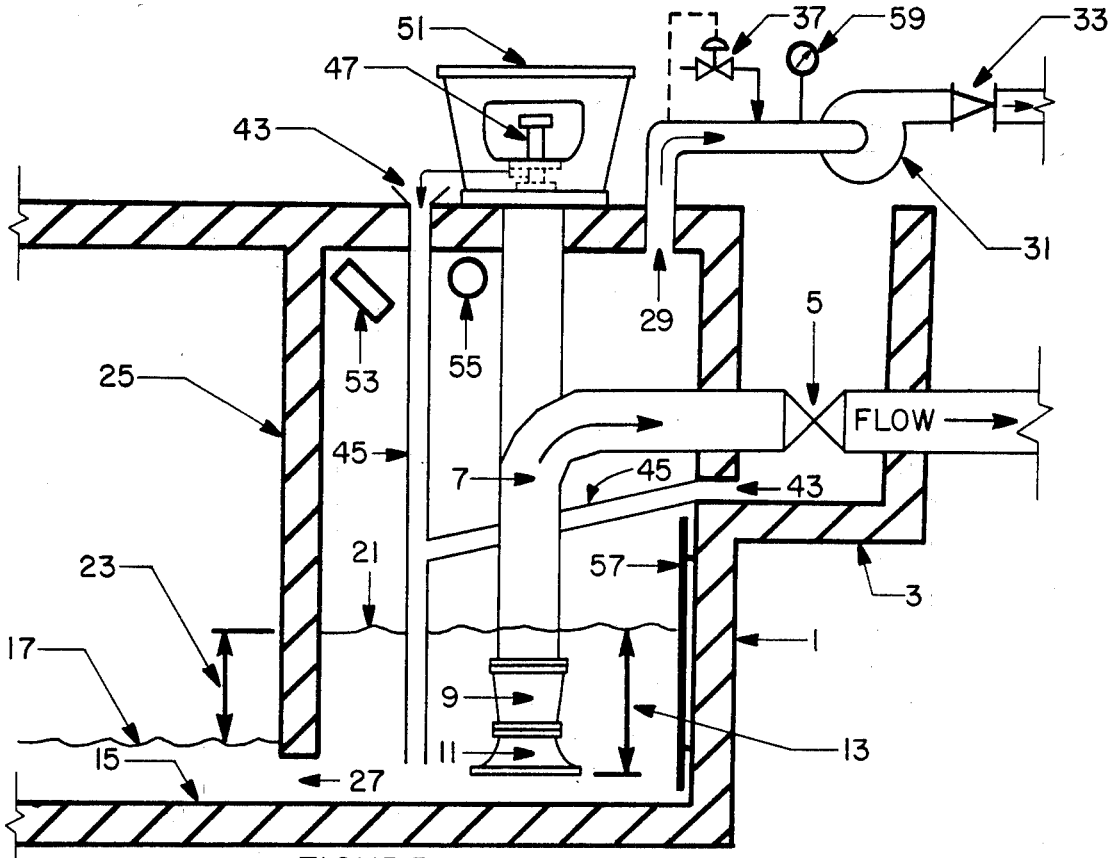
FIG. 3 is a cross sectional side elevation of the modified pumping chamber in the input support structure showing how the application of vacuum has raised the water level in the pumping chamber above the minimum submergence depth for the pump even though the reservoir level is too low for operation without vortexing.

A typical installation of a suction pump in a sump or intake support structure is shown in FIG. 1. The identifying numbers that are used in the various figures of the drawings are maintained throughout for ease in identifying the various components referred to. In FIG. 1 an intake structure and pump chamber 1 supports a vertical type pump 7 downwardly into the enclosure formed by the walls of the intake structure and pump chamber 1. Arrows indicate the direction of flow from the output of the pump 7 which includes a pump bowl assembly 9 which contains rotating members of the pump and a suction bellmouth 11 which is the intake or inlet for the pump 7. The vertical pump 7 is supported from the top of the intake structure 1 and a pump shaft and coupling 47 provides a means for connecting the pump mechanically to a motor (not shown) which is supported on a base or motor mounting 51. Rotation of the motor turns the shaft which rotates the pump members contained in the pump bowl assembly 9 which draws fluid from the enclosure of the support structure 1 through the suction bellmouth 11 to provide the output of the pump as shown by the arrows. The natural fluid level is shown as 17 above the bottom of the intake structure 15 which is determined by the natural gravitational level of the river or reservoir which provides a source of fluid on which the pump operates. The intake support structure and pump chamber 1 has walls which form an enclosure or boxlike structure which is open on one end to the river or reservoir or other source of fluid proper. This opening is generally guarded by bars to prevent things or objects in the reservoir from passing into the pump enclosure and closer to the pump there may be finer mesh screens or grids across the cross section of the opening to the reservoir to further reduce the chance that objects or chunks of ice can reach the area in which the pump is operating. These things are not shown in the drawings. The vertical type pump 7 is located in the enclosure in such a manner that its suction bellmouth 11 is a minimum distance from the bottom of the intake structure 15 as required by the manufacturer's specifications for the pump so that free flow of the fluid in the enclosure can take place during pump operation. Each pump has characteristic curves which require a minimum submergence distance of the pump 7 beneath the natural fluid level 17 which is indicated by the required submergence depth 13. One or more equipment drains 43 are installed in the intake structure so that leakage from shaft seals and valves is allowed to drain back into the enclosure or pumping chamber. A valve 5 is installed in the output pipe of the pump in order to restrict or cut off flow and this is referred to as a pump discharge valve 5 which is usually installed in a valve pit 3 which is externally connected to the intake support structure and the valve pit 3 may also have an equipment drain 43 communicating with the pump chamber enclosure as shown in FIG. 3. This keeps the valve pit free from filling up because of leakage of the pump discharge valve 5. Since the vertical type pump 7 in FIG. 1 is shown to have the required submergence 13 as required by the pump characteristics, the pump should operate normally as intended by the manufacturer.

Figure 2:
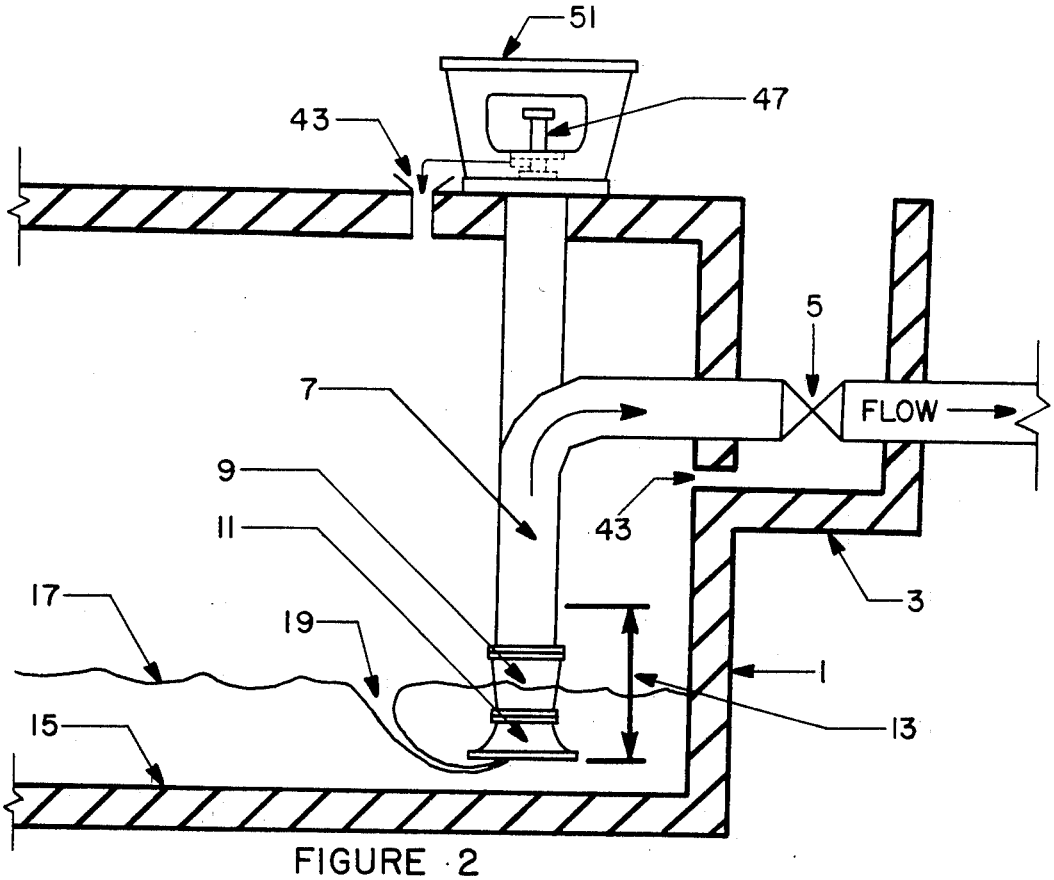
FIG. 2 shows a developed vortex entering the pump suction bellmouth when the natural fluid level in the input support structure of FIG. 1 is too low.

FIG. 2 illustrates the operation of the pump installation of FIG. 1 when the natural fluid level 17 falls below the required submergence for the pump 13. A "tornado" vortex 19 forms a swirling cone as illustrated in FIG. 2 which interferes with the satisfactory operation of the pumping system as indicated previously.

Given the low fluid reservoir level situation illustrated in FIG. 2, I have found that restoration of a satisfactory pumping operation can be accomplished by the changes which are shown in FIG. 3. In FIG. 3 a downwardly extending vacuum lift wall 25 from the top of the support enclosure 1 and abuttingly connected with the vertical side walls of a support enclosure 1 defines a further enclosure within the support structure 1 which forms an enclosed pumping chamber with an underwater opening 27 under the vacuum lift wall to provide entrance of fluid from the reservoir into the pumping chamber. The opening 27 must be sufficiently large so as to avoid undue flow restrictions of the fluid to the pump. The downwardly extending end of the vacuum lift wall 25 must be below the natural fluid level 17 so as to provide a fluid seal. The vacuum lift wall 25 may be fixedly or removably placed across the cross section of the intake structure 1 but care must be taken to seal it so that the atmospheric air above the fluid level 17 is not free to enter the pumping chamber defined by the input structure 1 and the vacuum lift wall 25. Any walls of the intake support structure, including the vacuum lift wall, which define the enclosed pumping chamber must be strong enough to withstand the vacuum which will be present during operation.

Extensions 45 to the equipment drains 43 are sealably attached so that their opening is extended to below the bottom of the vacuum lift wall 25. This is necessary in order to prevent atmospheric air from entering the pumping chamber during operation. Other openings into the chamber which are above the lowest natural fluid level must also be sealed for the same reason. Equipment drains may be routed sealably through the chamber to the atmosphere as with the drain extension 46.

A vacuum source connection 29 communicating with the pumping chamber is connected to a source of vacuum such as a vacuum pump 31 so that a vacuum may be drawn in the pumping chamber during operation. The result is a raised water level 21 inside the pumping chamber when a vacuum is established in the pumping chamber which is related to the difference between the pressure inside the chamber and the atmospheric pressure outside. A vacuum lift 23 is thus established between the natural fluid level and the fluid level in the pumping chamber which reestablishes the required submergence depth 13. This condition is obtained even though the actual natural fluid level in the reservoir would otherwise be too low for the proper operation of the pump. The depth 13 is maintained by continuously maintaining a vacuum into the system. It is desirable to provide a vacuum gauge 59 at the inlet to the vacuum source so as to measure the vacuum obtained in the system. A vacuum pressure regulation valve 37 is also installed so as to permit regulation of the vacuum produced by the vacuum source in the pumping chamber. A vacuum pump check valve 33 is installed on the output of the vacuum source to avoid possible reverse rotation by flow reversal on shut down.

A constant raised level in the chamber can be maintained by adding level measuring device within the chamber which provides a signal that feeds back into the vacuum pressure regulation valve to adjust the vacuum setting that it regulates to. A constant level may be desirable to avoid raising the chamber fluid level more than required for vortexing so as to minimize the vacuum requirements of the system as the reservoir level changes.

Figure 4:
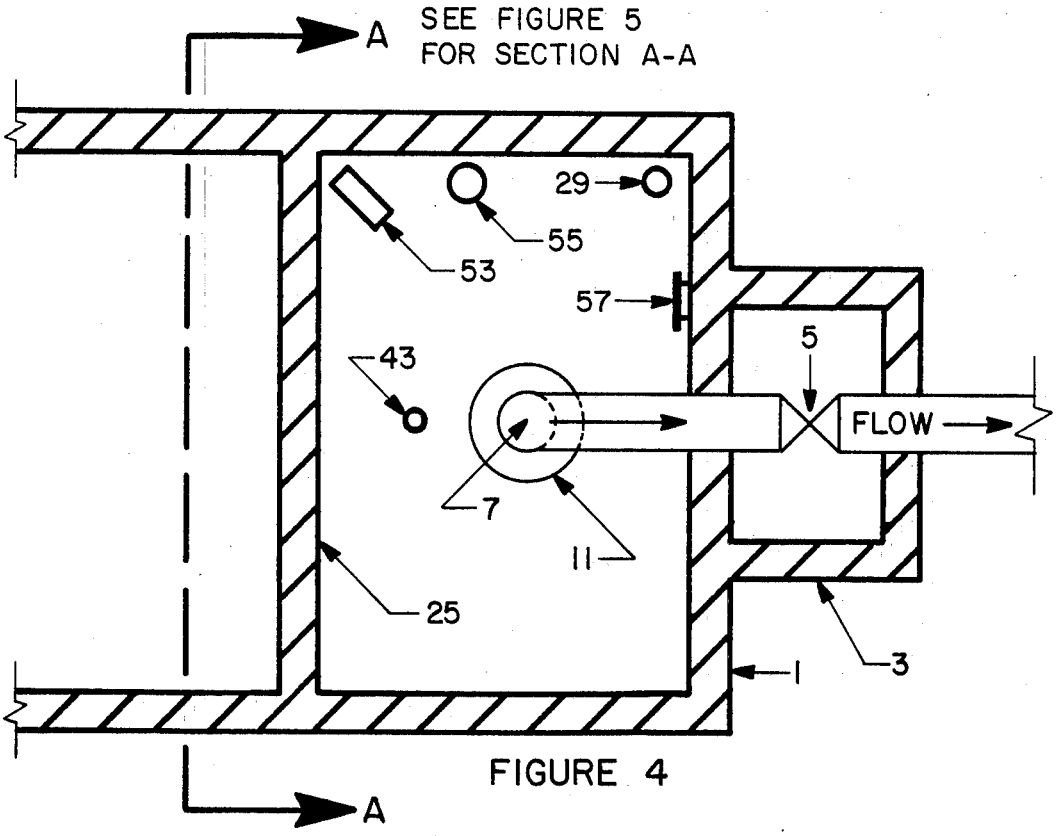
FIG. 4 is a plan view of the modified input support structure of FIG. 3.

FIG. 4 is a plan view of the pumping chamber of FIG. 3 which shows the installation of a closed circuit TV camera 53, a light 55 and a level scale 57 which are enclosed in the pumping chamber as shown in FIG. 3 and provide a means for monitoring the actual vacuum lift 23 so that the vacuum can be adjusted within the chamber to increase or reduce the fluid level in the pumping chamber in accordance with changed conditions. Some means of monitoring the level in the chamber is desirable because of changes in atmospheric pressure, vacuum or reservoir natural fluid level which can effect the raised level that is obtained. The vacuum source must be sized to provide excess capacity over all the leakage of air that is present in the chamber in order to draw enough vacuum so that it can be adjusted to vary the vacuum in the chamber in order to achieve the desired fluid level.

Figure 5:
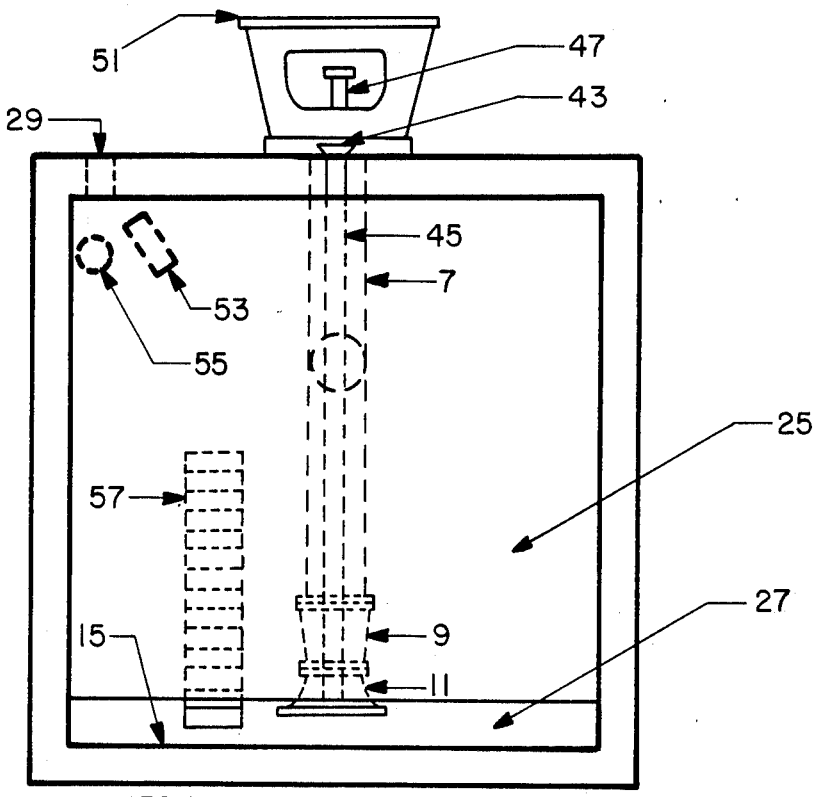
FIG. 5 is a cross sectional end elevation on the line A—A indicated on FIG. 4.

FIG. 5 is a view on the Section A—A of FIG. 4 which shows the vacuum lift wall 25 and the opening 27 through which the incoming fluid travels on its way to the pump suction intake 11. A better view of the scale 57 is seen which may be calibrated in terms of absolute elevation above sea level so as to correlate the level in the pumping chamber with measurements obtained from a river or reservoir.

Figure 6:
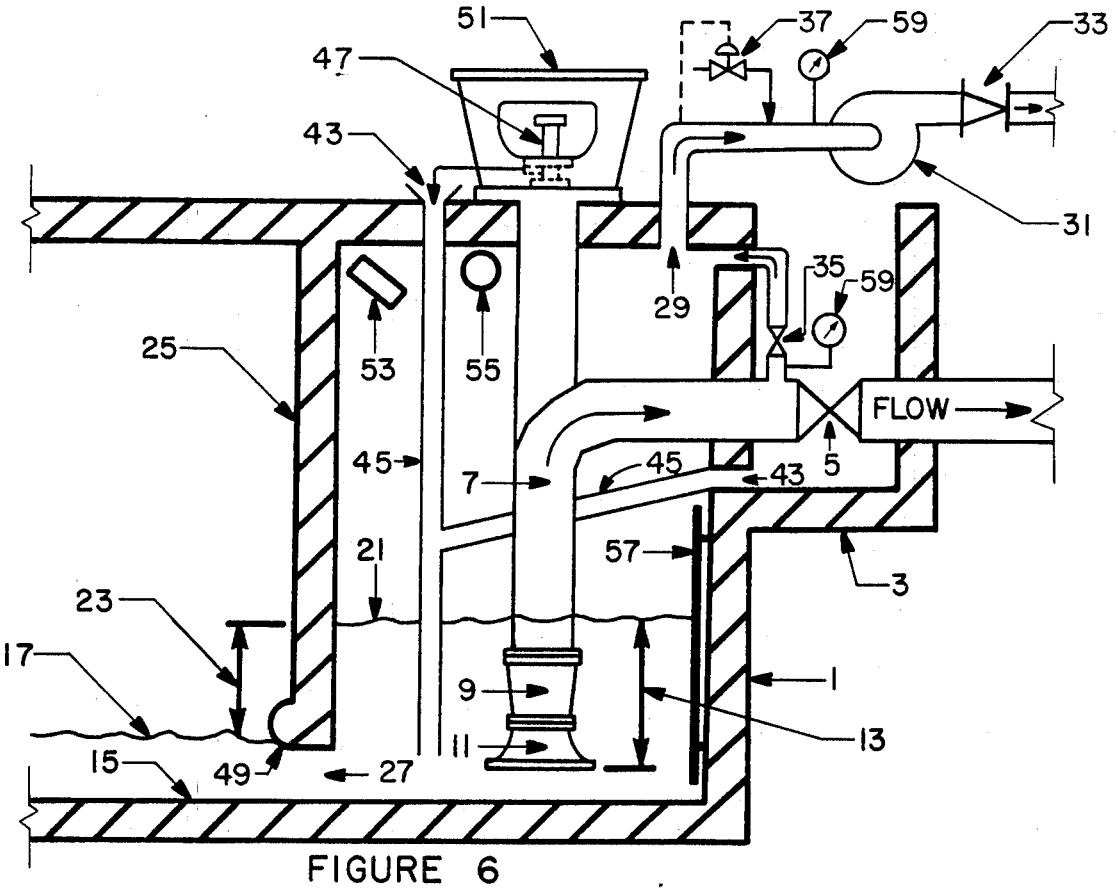
FIG. 6 is similar to FIG. 3 with the addition of a pump priming valve and inlet 35 and a flow smoothing extension 49 of the downwardly extending pump chamber wall.

FIG. 6 is another view of the invention shown in FIG. 3 which shows a smooth, rounded extension 49 on the fluid contacting lower end of the vacuum lift wall 25 which is used to smooth the flow of fluid through the inlet 27 to the vacuum lift pumping chamber. This can become critical if the vacuum lift wall 25 is extended closer to the bottom 15 to handle an even lower fluid level 17 because it reduces the flow resistance of the fluid into the pumping chamber. If the opening 27 is insufficient to provide incoming flow equal to the output of the pump it could require additional vacuum to maintain required submergence 13 and NPSHA is reduced which could move the system closer to any cavitation limit that exists.

If it becomes necessary to establish a vacuum and therefore a lift before the main pump is started, provisions to prime the pump should be incorporated into the design. This can be accomplished in the vacuum lift system by installing a valve 35 that connects the vacuum chamber to the pump internals. The pump must then be started with a closed discharge valve and with the priming valve 35 open. This allows the fluid level inside the idle pump to be the same as the raised level in the pump chamber and this can be verified by means of a gauge 59 shown in FIG. 6. Once the main pump was started the valve 5 is opened and the pump priming valve 35 is closed for operation.

Figure 7:
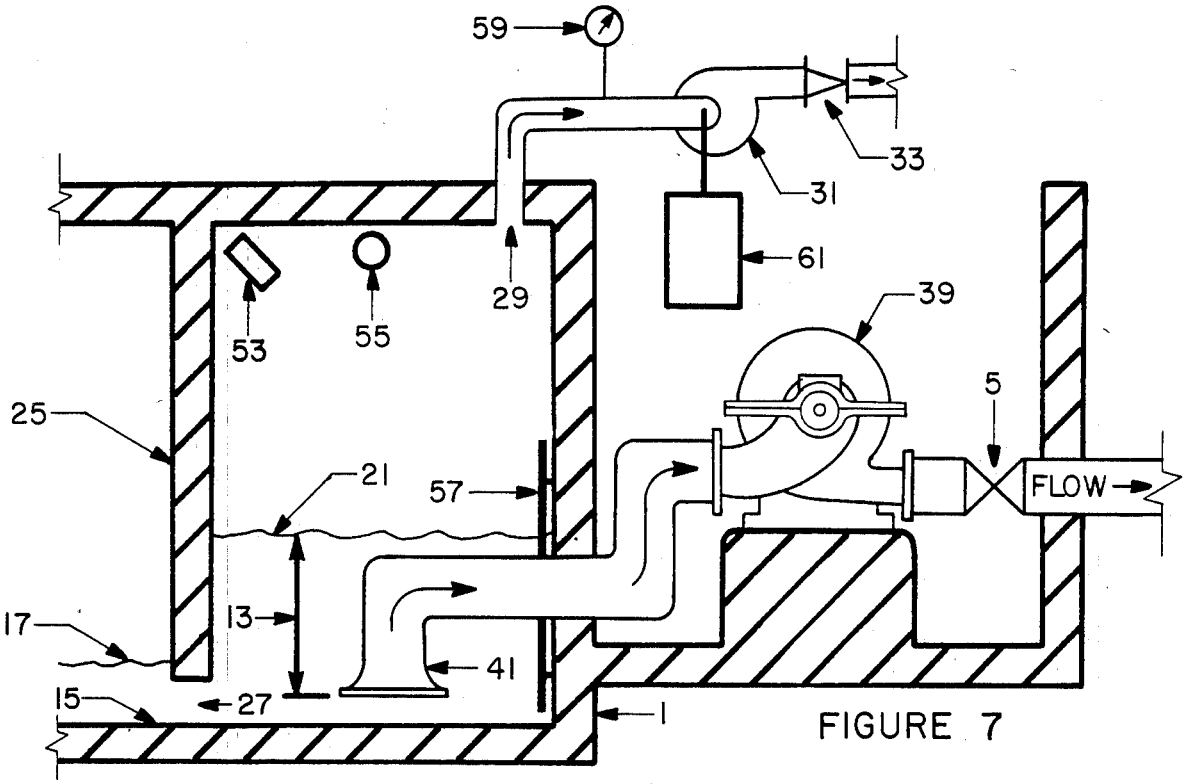
FIG. 7 is a cross sectional elevation of an alternative use of the invention with an externally mounted pump communicating with the pumping chamber through an intake pipe extension.

The invention is not limited to suction pumps that are enclosed within the pumping chamber and will work equally well with externally located pumps as illustrated in FIG. 7. Here a horizontal type pump 39 is mounted outside the pumping chamber and communicates with the pumping chamber of the vacuum lift system by means of a bellmouth and pipe extension 41 which is placed in the chamber in a manner similar to the bellmouth 11 of the vertical type pump. The vortexing problem occurs in this type of installation and pumps of this type have a required submergence 13 that are characteristic in the same manner as the vertical pump installation. FIG. 7 also illustrates a different way of controlling the vacuum in the pumping chamber and thus the vacuum lift 21 by means of a variable speed vacuum pump drive 61 which may be adjusted to provide more or less vacuum in the chamber.

Figure 8:
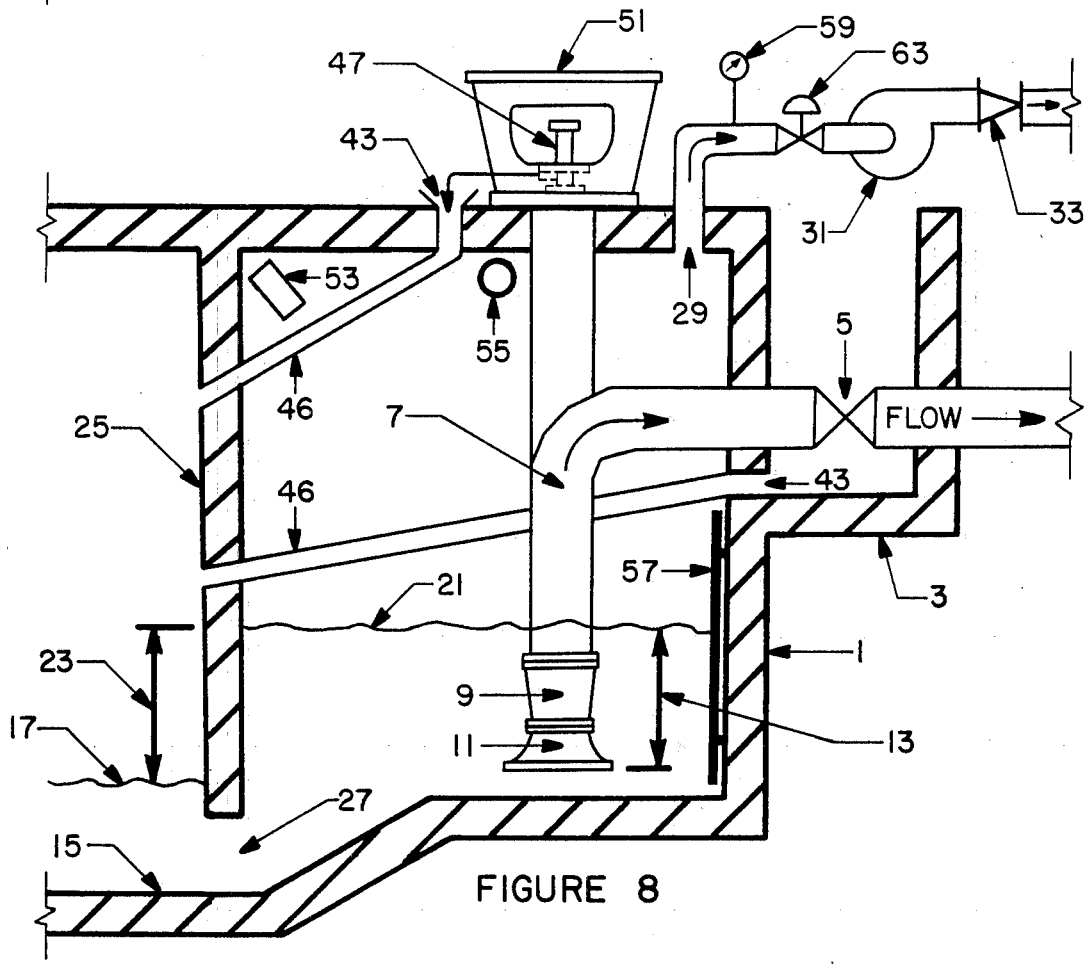
FIG. 8 is a cross sectional elevation of the input support structure and pump chamber showing how the invention can be used to provide the minimum required submergence depth in a modified input support structure and pump chamber which minimizes the cost of construction and permits vortex free operation even where the pump suction bellmouth is above the available fluid reservoir level.

FIG. 8 illustrates that the use of the invention is not limited to an inlet support structure and chamber having a flat horizontal floor. The lift to provide the required submergence 13 can be obtained where the intake structure defining the vacuum lift chamber has a different floor elevation than the other portions of the intake structure. This is sometimes desirable because of the particular location of the installation and can greatly reduce the cost of building cofferdams and can reduce other construction costs because of the massive size of the intake structures required for many large volume pumping applications. FIG. 8 shows how the vacuum lift wall opening inlet 27 can actually be below the floor elevation at the pump. In this case the inlet 11 at the bottom of the pump might be open to the atmosphere after shutdown because once the vacuum was lost the fluid would drain back into the reservoir leaving the pump out of the fluid. This requires only that the parts (output line) of the pump 7 be isolated from the atmosphere with appropriately positioned valving to oppose flow of atmosphere into the pumping chamber until a vacuum is reestablished and the pump is primed for startup.

Still another method of controlling the vacuum is shown in FIG. 8. A suction regulator pressure valve 63 may be installed in the line coming from the vacuum source with a vacuum guage 59 on the pumping chamber side of the line which controls the vacuum by restricting the flow going to the vacuum pump.

There are a number of devices such as floating gridworks or horizontal perforated screens that are known to interfere with vortex formation in pumping chambers which can reduce the required submergence depth below the depth the pump otherwise requires but not to the extent made possible with my invention. These other devices can be used with my invention and to the extent they reduce the depth required to eliminate vortexing my invention will still further reduce that depth and do so with a lower vacuum requirement which can reduce the vacuum power and size requirements since the vacuum lift need only go as high as the other devices require for vortex free operation.

The best mode is illustrated by a full scale vacuum lift system installation with an intake support structure and pumps that convey river water through the condenser tubes of a 300 megawatt electric power generating station. Two identical Allis Chalmers vertical pumps equally share the flow requirement of the system. Each pump is designed to deliver 64,000 gallons per minute (GPM) with a total dynamic head of 44 feet. The source of water was a river which had permanently lowered its average level. Variation in flow rate of 58,000 GPM to 90,000 GPM from each pump was experienced due to various operating conditions of the circulating water system.

The pump 7 mounted at ground level at the top of the intake structure was at an elevation of 1078 feet above sea level. The floor of the chamber was at an elevation of 1045.25 feet. The pump extended down into the pump chamber until its lower most bellmouth 11 was three feet above the floor of the pump chamber. The pump operating speed was 440 RPM with a 900 horse power electric induction motor. The motor is installed on a motor base 51 and connected to the pump shaft and coupling 47.

The diameter of each pump column was approximately 4'6" and the center line of the pumps was approximately 12' behind the vacuum lift wall and 5'7" in front of the back wall of the pump chamber. Each pump has a discharge valve 5 in a separate chamber called a valve pit 3 external of the pump chamber. The submergence requirement of the pump 13 was 7' and when the pump was operated with a natural water level 17 below the required submergence level, a vortex problem developed. As the natural water level in the river source became lower the vortexing problem was increased. The vortex became severe enough to carry air and debris into the pump causing mechanical and hydraulic disturbances in the pump which resulted in down time and excessive maintenance cost. Air got into the pump output which required the more frequent use of air removal systems in the steam condenser water box.

A vacuum lift wall 25 was constructed of structural steel and steel plates. The wall was lowered into the pump chamber so that an opening 27 which was 4.5' high by 11'2" wide was left between the floor of the pump chamber and the bottom of the wall. Vertical slots (existing) in the side walls of the intake support structure were utilized to hold the vacuum lift wall in place and it was fixed mechanically up against soft rubber pads in the vertical slots to minimize air infiltration into the pumping chamber. This was done in such a way that any incoming water flow against the vacuum lift wall from the river side and the vacuum tend to urge the wall tighter against the rubber pads. Although the vacuum lift wall was constructed of steel with a protective primer coating, the materials of construction of the wall are not important and it could have been made of concrete or galvanized steel. Any construction features that avoid or minimize the problems of sealing the surfaces will also minimize air infiltration into the chamber. The chamber area enclosed by the vacuum lift wall measured 25'3" by 11'2". There was only one opening available to install the vacuum lift wall in the sidewalls of the existing intake support structure and this opening resulted in a 12' horizontal distance between the lift wall and the center line of the circulating water pump. Flow distribution of the water going to the pump was adequate. It may be possible to still further improve the operation of the system by conducting a model study of fluid flow to simulate a proposed new full scale installation.

A connection 29 was made in the pump chamber to which the input of a vacuum pump 31 was piped. It was obtained from the Roots Blower Division of Dresser Industries, Inc. It was capable of removing 915 cubic feet per minute of air at a vacuum of 10" of mercury and was driven by a 50 horse power electric motor. A check valve 33 was installed in the discharge of the vacuum pump to prevent reverse rotation at shut down which can occur if reverse flow is allowed to take place. The vacuum pump was oversized so that it would handle air infiltration, air removed from the water, and any air introduced into the suction of the vacuum pump deliberately for the purpose of establishing a constant controlled vacuum. The volume of air left in the pumping chamber when a vacuum was applied to create a raised water level 21 sufficient to restore the minimum submergence of the pump was approximately 4,000 cubic feet.

A vacuum pressure regulation valve 37 provides the controlled vacuum feature and by permitting more or less air into the vacuum system it determines the lift 23 to which the water in the vacuum pumping chamber will be raised. Other methods to control the lift of the water level in the pumping chamber can be used. One such method would be to vary the speed of the vacuum pump 61 so that it removes only the air needed to maintain the needed vacuum. This would reduce the vacuum pump power requirements to a minimum which would become more important if the vacuum was needed all year long. My installation is only operated about three months of the year when the river level is very low. Another method available is to install a pressure regulating valve 63 on the air removal system so that the vacuum pump can operate a one vacuum and the pump chamber at a different vacuum.

Any openings into the pumping chamber such as the drains commonly used which are referred to as "equipment drains" 43 were extended to below the vacuum lift wall opening to prevent air from entering through the drain. This is necessary to avoid loss of vacuum in the pump chamber and to minimize the vacuum power requirements. The equipment drains 43 can also be fitted with extensions 46 to sealably pass through the pumping chamber as shown in FIG. 8 for the same purpose.

A smoothed inlet 49 was incorporated into the lower portion of the vacuum lift wall for the purpose of reducing frictional losses through the opening and to establish a more streamline flow pattern of water as it enters the pump chamber. The rounded section was made of steel pipe which formed a 12" radius semi-circular extension of the lower end of the wall. The 12" radius was chosen because it was the largest dimension that could be used and yet fit into the opening available to install the vacuum lift wall.

Since the newly constructed chamber prevents all natural light from entering a light 55 was installed. Observation of any vortex indications and of the raised water level was accomplished by installing a closed circuit TV camera system 53. A scale 57 was installed on the back wall of the pump chamber to measure fluid elevation in the chamber. This surveillance equipment was an aid to evaluating the performance of the vacuum lift system although it is not absolutely necessary for a satisfactory vacuum lift system operation. A reasonable indication of the amount of lift was measured with a vacuum gauge 59 on the vacuum pump connection to the chamber shown in FIG. 3. The scale of the vacuum gauge can be calibrated in feet of liquid so that a direct lift reading can be available which requires no further calculations. A higher water elevation follows the maintenance of a higher vacuum.

Operating instructions were issued to start the circulating water pump before a vacuum was established. The pump normally starts with the output valve 5 at a 20% open position. This procedure was needed to avoid a problem that could develop when the vacuum system removes the water from the idle pump leaving it dry before starting. If it becomes necessary to establish a vacuum and therefore a lift, before the main pump is started, provisions to prime the pump may need to be incorporated in the design. This can be accomplished with the vacuum lift system by installing a valve 35 that connects the vacuum chamber to the pump externals. The pump must then be started with a closed discharge valve with the priming valve open. This would allow the water level inside the idle pump to be the same as the raised level in the pump chamber. There are other conventional ways known or priming the pump.

A test was performed to cause the natural water level to be lowered until a loss of vacuum condition occurred. This was accomplished with the vacuum lift system and the circulating water pump in service. Very stable operation was observed with no vortexing in front of the vacuum lift wall or in the pump chamber until the natural water level was lowered to within 3" of the vacuum lift wall opening. Natural water levels below that point caused an oscillation effect of partial loss of vacuum followed by a regaining of the vacuum. The frequency of the oscillation was approximately every 6 seconds. The oscillation did not effect the pumping capability of the pump and vortexing was not present because of the frequent level changes. Some time is required for a vortex to form.

The frequency of oscillation is dependent upon the vacuum pump capacity and ability to recover from a partial loss of vacuum. My vacuum pump had tne capability of lifting the water 7' in two minutes when starting from a natural water level. A vacuum cannot be maintained if the natural water level is below the opening created by the bottom of the vacuum lift wall. The vacuum lift system is ineffective at that point.

If it is attempted to obtain operation at still lower water levels by lowering the opening to the pump chamber created by the vacuum lift wall a problem can develop as a result of additional frictional losses created by the smaller opening. These friction losses can reduce the NPSHA to the pump. The pump NPSHR characteristics must be considered in all applications. In our installation the water intake opening of the tested pump vacuum lift system had a negligible frictional loss (approximately 4" of water), so the effect on NPSHA is negligible. This means the absolute pressure available to the pump is essentially not affected by the vacuum lift system operation.

Although a lift of 7' was accomplished with the equipment installed, significantly larger lifts are possible with this system. The main limiting factors include barometric pressure, the liquid vapor pressure, and the vacuum capability of the air removal system. When application of a vacuum lift is considered to control vortexing, cavitation problems must be separately evaluated using the NPSHR curve provided with the pump documentation. The inventor believes that a cavitation limitation will be reached before a physical vacuum lift limitation is reached in most installations. Applications at high elevations above sea level could significantly effect the lifting limitation, however. It should be noted that some fluids with high vapor pressure or at elevated temperature where boiling can occur may render the invention inoperable because of inability of a vacuum source to keep up.

I claim:

1. A suction pump vortex control system which comprises:

a. means defining an enclosure having at least one opening to a fluid reservoir and with other openings sealed from the atmosphere, b. vacuum lift wall means in the enclosure communicating sealably with the other walls of the enclosure to form a pumping chamber wherein said wall means includes said at least one opening into the chamber and being disposed below the surface of the reservoir between said chamber and said fluid reservoir, c. a suction pump intake positioned in the enclosure above the bottom of the chamber of said enclosure for a pump connected to said intake which has a required submergence depth for prevention of vortexing, d. means for introducing and maintaining a vacuum in said chamber which is sufficient to lift the fluid level in the enclosure to the required submergence depth of the pump while fluid is pumped.

2. The suction pump vortex control system of claim 1 wherein the means for maintaining a vacuum includes a control means for adjusting the vacuum in the chamber to vary the lift obtained.

3. The suction pump vortex control system of claim 2 wherein the means for adjusting the vacuum control includes a chamber level feedback means to control the fluid level in the chamber.

4. The improvement of claim 2 wherein the control means includes an adjustable calibration means for predeterminedly setting the vacuum lift to accommodate changed conditions.

5. A method of eliminating vortexing in a suction pumping system having less than the required pump submergence depth for elimination of vortexing which comprises:

a. enclosing an inlet for a pump in a vacuum resistant chamber, b. sealing the chamber from the atmosphere, c. connecting the chamber to a fluid reservoir through at least one submerged opening in the chamber, d. lifting the fluid in the chamber above the reservoir level to the required level for vortex elimination, with a chamber vacuum, and, e. pumping the reservoir fluid with the fluid pump while maintaining the fluid level in the chamber with the chamber vacuum.

6. The method of claim 5 wherein the enclosure has a downwardly extending wall to form the chamber for the pump inlet which extends below the reservoir surface level and in communication with a reservoir fluid wherein the extended wall defines a submerged opening above the floor of the chamber enclosure to permit substantially unrestricted flow to the pump.

7. The method of claim 5 wherein the fluid in the chamber is lifted with a vacuum source provided by a mechanical vacuum pump.

8. The method of claim 5 wherein the fluid in the chamber is lifted with a vacuum source provided by a jet ejector.

9. The method of claim 5 or 7 or 8 wherein fluid in the chamber is lifted controllably with control means communicating with the vacuum source for adjusting the vacuum in the chamber to vary the lift obtained.

* * * * *